US009797667B2

(12) United States Patent
Demierre et al.

(10) Patent No.: US 9,797,667 B2
(45) Date of Patent: Oct. 24, 2017

(54) MAGAZINE FOR A FIREARM PROVIDED WITH A DEVICE INDICATING THE NUMBER OF REMAINING CARTRIDGES

(71) Applicant: TECHTONIQUE SA, Cerniat (CH)

(72) Inventors: Jacques Demierre, Cerniat (CH); Yvan Magnin, Hauteville (CH)

(73) Assignee: Techtonique SA, Cerniat (CH)

( * ) Notice: Subject to any disclaimer, the term of this patent is extended or adjusted under 35 U.S.C. 154(b) by 0 days.

(21) Appl. No.: 14/907,755

(22) PCT Filed: Jul. 10, 2014

(86) PCT No.: PCT/IB2014/062999
§ 371 (c)(1),
(2) Date: Jan. 26, 2016

(87) PCT Pub. No.: WO2015/011596
PCT Pub. Date: Jan. 29, 2015

(65) Prior Publication Data

US 2016/0169602 A1 Jun. 16, 2016

(30) Foreign Application Priority Data

Jul. 26, 2013 (EP) ..... 13178242

(51) Int. Cl.
*F41A 9/62* (2006.01)
*F41A 9/70* (2006.01)

(52) U.S. Cl.
CPC . *F41A 9/62* (2013.01); *F41A 9/70* (2013.01)

(58) Field of Classification Search
CPC ..... F41A 9/62; F41A 9/70; F41A 19/01
(Continued)

(56) References Cited

U.S. PATENT DOCUMENTS 1,252,094 A 1/1915 Lempeles
1,126,726 A * 2/1915 Diestelkamp ..... F41A 17/38 42/1.02

(Continued)

FOREIGN PATENT DOCUMENTS

FR 463244 A 2/1914
KR 10-2009-0114712 A 11/2009

(Continued)

OTHER PUBLICATIONS

Rapport de Recherche Internationale (International Search Report); European Paten Office; International PCT Application No. PCT/IB2014/062999; Sep. 2, 2014; 7 pages.

(Continued)

*Primary Examiner* — Stephen M Johnson
*Assistant Examiner* — Benjamin Gomberg
(74) *Attorney, Agent, or Firm* — Taft Stettinius & Hollister LLP

(57) ABSTRACT

A self-contained magazine intended for a firearm, including a main housing configured to receive a plurality of cartridges and having an open upper end through which the cartridges are loaded and unloaded, a follower arranged relative to the main housing and able to slide in a longitudinal axial direction along the main housing, a spring urging the follower toward the upper end so as to push the cartridges toward the upper end, a secondary housing fixed and preferably removably relative to a substantially planar lower end of the main housing, and an indicator device arranged at least partially inside the secondary housing to indicate the number of cartridges contained in the main housing.

18 Claims, 8 Drawing Sheets

(58) Field of Classification Search
USPC ..... 42/1.01–1.03, 1.05
See application file for complete search history.

(56) References Cited

U.S. PATENT DOCUMENTS

| | | | | | |
|---|---|---|---|---|---|
| 1,451,339 | A * | 4/1923 | Kottas | F41A 9/76 | 42/1.02 |
| 2,114,311 | A * | 4/1938 | Nomar | F41A 9/65 | 42/1.02 |
| 4,558,626 | A * | 12/1985 | Bartolles | F41A 9/62 | 42/1.02 |
| 5,206,444 | A | 4/1993 | Oliver | | |
| 7,730,654 | B2 * | 6/2010 | Kim | F41A 9/62 | 42/1.02 |
| 8,991,084 | B2 * | 3/2015 | Williams | F41A 9/62 | 42/1.02 |
| 2011/0308125 | A1 | 12/2011 | Gabay et al. | | |

FOREIGN PATENT DOCUMENTS

| | | | |
|---|---|---|---|
| WO | 98/35200 | A1 | 8/1998 |
| WO | 2008/132739 | A2 | 11/2008 |
| WO | 2009/038845 | A2 | 3/2009 |

OTHER PUBLICATIONS

Opinion Ecrite de L'Administration Chargee de la Recherche Internationale (Written Opinion); European Patent Office; International PCT Application No. PCT/IB2014/062999; Sep. 2, 2014; 5 pages.

* cited by examiner

MAGAZINE FOR A FIREARM PROVIDED WITH A DEVICE INDICATING THE NUMBER OF REMAINING CARTRIDGES

This application is a U.S. national stage filing of International Application No. PCT/IB2014/062999 filed on Jul. 10, 2014, which claims priority to European Application No. 13178242.7 filed on Jul. 26, 2013, the contents of each application incorporated herein by reference in their entirety.

TECHNICAL FIELD

The present invention relates to a magazine for a firearm, provided with a device that indicates the number of remaining cartridges.

The present invention also relates to a firearm equipped with said firearm magazine.

PRIOR ART

In present-day firearms, devices have been developed that indicate the number of cartridges remaining in the magazine. However, these devices of the prior art have a certain number of disadvantages.

Thus, there are magazines that have numbered pockets or transparent magazines made of plastic so that the number of cartridges remaining in the magazine can be easily seen. However, these solutions require the magazine to be elected from the firearm in order to be able to read or count the number of cartridges that remain. These solutions therefore require several handling operations on the part of the shooter so that he can acquaint himself with the number of cartridges contained in the magazine. They are therefore not suitable for risky situations during which it is of vital importance for the shooter to determine the content of his magazine quickly and easily.

In order to address this set of problems, other solutions, such as those described for example in patents FR 463 244 and U.S. Pat. No. 5,206,444, envisage the use also of a butt that is at least partially transparent so that the content of the magazine can be seen. However, these solutions do not work with conventional weapons in which the butt is not generally transparent.

Other solutions also envisage the use of electronic means for detecting the number of cartridges contained in the magazine and displaying this on an external display device incorporated into the weapon. These solutions however require the use of special-purpose magazines which are relatively expensive and complicated to manufacture. They are therefore not readily suited to conventional commercially-available magazines. In addition, they require a source of electrical energy.

The solution described in patent application KR 2009-0114712 provides a partial solution to these problems. Indeed it proposes equipping a conventional magazine with an extension in which is housed a device that indicates the number of cartridges contained in the magazine. This indicating device notably uses a wheel comprising a series of consecutive figures, uniformly spaced about its circumference, the angular position of the wheel being dependent on the position of a follower that pushes the cartridges in the magazine. Thus it is possible to see, through an opening made on a lateral face of the extension of the magazine, the figure on the wheel that corresponds to the number of cartridges contained in the magazine. However, with this solution, the extension protrudes significantly beyond the butt when the magazine is in place inside the weapon. This solution therefore does not make it possible to offer compact magazines that fit seamlessly into a firearm. Neither does it make it possible to offer firearms equipped with said magazines that are both discrete and lacking in bulk. In addition, when the user wears the weapon in a belt holster, the extension that protrudes from the holster makes the weapon easier for a third party to grab. The extension may also inconvenience the user when firing and, as a result, have an impact on the precision of his aim. Moreover, because of the lateral positioning of the opening, the display of the number of cartridges contained in the box is hidden by the arm or hand of the shooter when firing. This solution therefore does not allow the shooter to acquaint himself with the content of the magazine while at the same time continuing to fire.

DISCLOSURE OF THE INVENTION

The present invention therefore seeks to provide a simple and effective solution to the aforementioned problems.

To that end, according to the invention, there is proposed a self-contained magazine intended for a firearm, comprising.

- a main housing intended to receive a plurality of cartridges, said main housing comprising an open upper end through which the cartridges are loaded and unloaded,
- a follower arranged in said main housing, said follower being able to slide in a longitudinal axial direction of said main housing,
- a spring urging the follower toward said upper end so as to push the cartridges toward said upper end,
- a secondary housing fixed, preferably removably, to a substantially planar lower end of said main housing,
- an indicator device arranged at least partially inside said secondary housing and intended to indicate the number of cartridges contained in the main housing, characterized in that the indicator device comprises:

- a rotary drum, referred to as winding drum arranged inside the secondary housing and of which the axis of rotation is substantially perpendicular to the plane defined by the lower end of the main housing,
- a flexible connecting means intended to connect the follower to said winding drum, said winding drum being configured to allow said flexible connecting means to be wound and, respectively, unwound, around at least part of the peripheral perimeter thereof as said follower nears or, respectively, moves away from, said lower end,
- a tensioning means intended to tension the flexible connecting means, notably as it is being wound around the winding drum,
- at least one deflection means intended to alter the direction defined by the flexible connecting means in such a way that said direction is substantially parallel to the axial direction of the main housing in a portion extending between the follower and said deflection means and that said direction is substantially parallel to the plane defined by the lower end of the main housing in a portion extending between said deflection means and the winding drum,
- a display means intended to display the number of cartridges contained in the main housing according to the angular position of the winding drum. Other possible configurations of the invention are defined in claims 2 to 16.

Configured in this way, the magazine of the present invention notably makes it possible to determine the number of cartridges contained in the magazine of a firearm without having to eject the magazine from the magazine housing of the firearm and without having to cease fire. Moreover, this magazine can easily be fitted to most conventional firearms without requiring significant and inconvenient modifications to said firearms or to the magazine used in these firearms.

The present invention also relates to a firearm according to claims 17 and 18.

BRIEF DESCRIPTION OF THE DRAWINGS

Further advantages and features of the present invention will be better understood from reading about two particular embodiments of the invention and by referring to the drawings in which.

DETAILED DESCRIPTION OF ONE EMBODIMENT OF THE INVENTION

Figure 1:
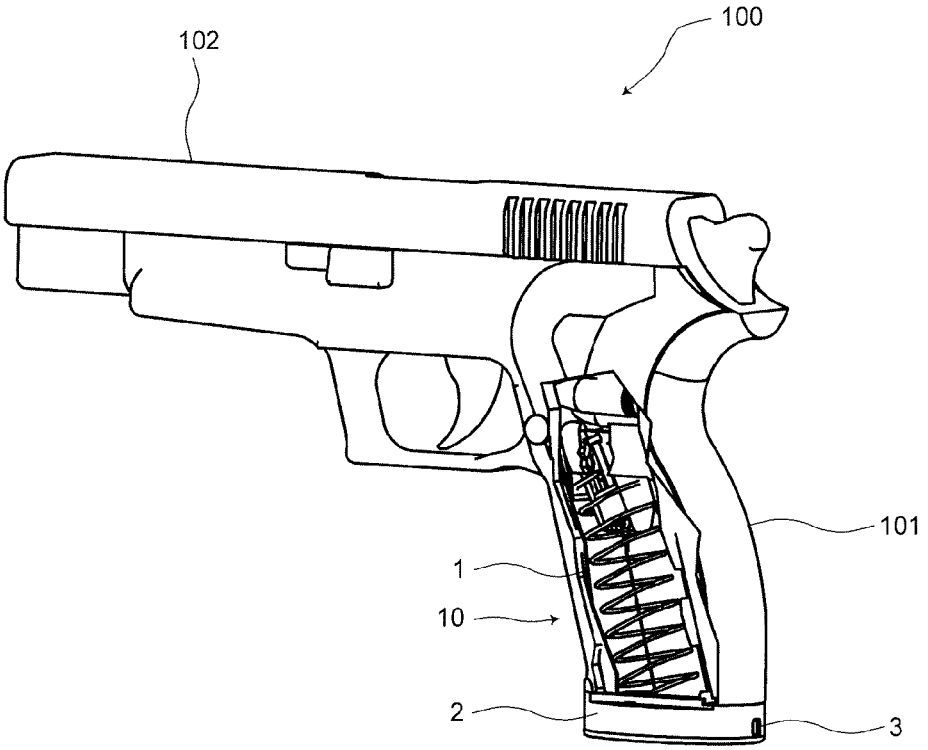
FIG. 1 is a perspective side view with partial cutaway of a firearm incorporating a self-contained magazine according to the invention.

Reference is made to FIG. 1 which depicts a firearm equipped with a self-contained magazine according to the invention. This firearm 100 advantageously has a butt 101 intended to be held in the hand of the user when he fires with the firearm. An internal housing of said butt 101 is configured to at least partially accept the self-contained magazine 10. As described in detail in the paragraphs which follow, the magazine 10 has two main parts, namely a main housing 1 and a secondary housing 2 extending under this main housing 1. In the operating position depicted in FIG. 1, the main housing 1 is fully housed inside the butt 101 and the secondary housing 2 forms an extension underneath the butt 101. For the sake of the compactness and ease of handling of the weapon, the secondary housing 2 has been designed so that it does not excessively protrude beyond the butt 101. In particular, the height of this secondary housing 2, as measured in a direction perpendicular to the planar lower end face of the butt 101, will advantageously be less than 2 cm and preferably less than 1 cm. Furthermore, the secondary housing 2 is advantageously provided with an opening 3 through which the number of cartridges contained in the magazine 10 is displayed. This opening 3 will advantageously be positioned in such a way that it faces toward the user when he is holding the butt 101 in his hand and aiming the barrel 102 of the weapon 100 toward the target he is shooting at. Thus, the user will at all times be able to determine the actual contents of the magazine without having to eject the magazine from the weapon and without having to cease fire.

Figure 2:
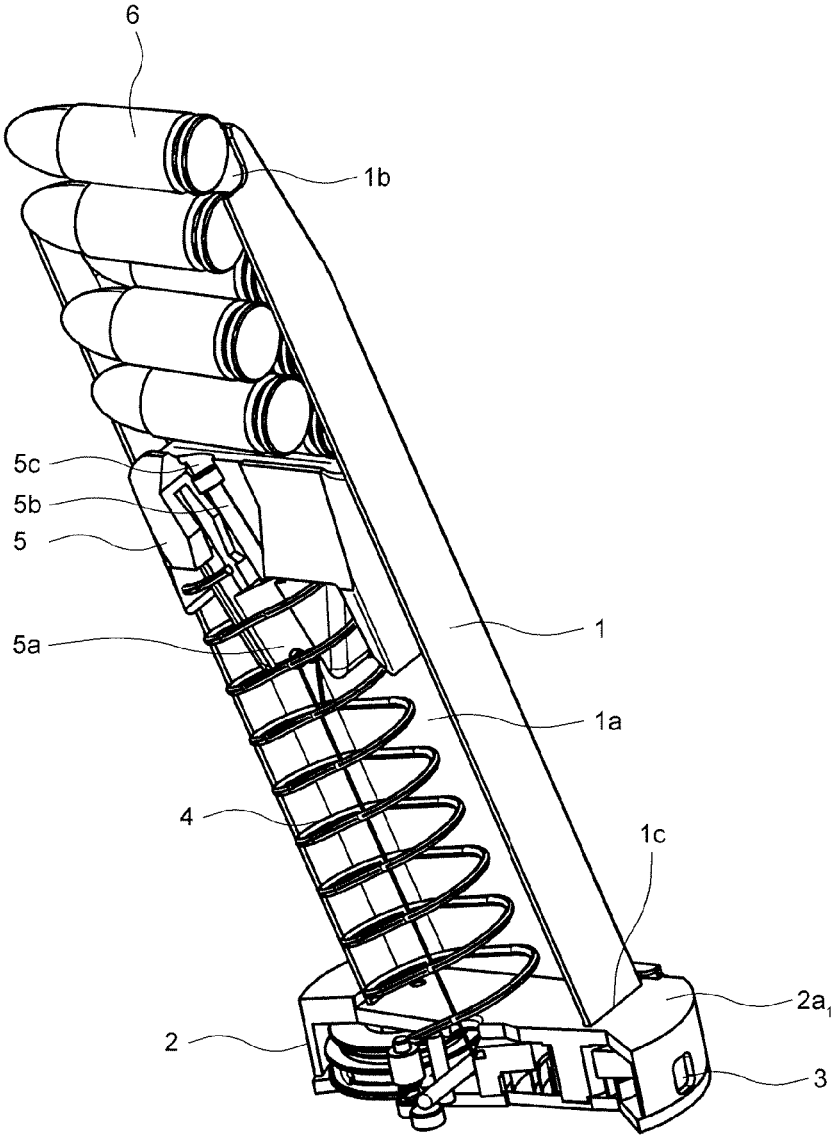
FIG. 2 is a perspective side view with cutaway of a self-contained magazine according to a first configuration of the invention.
Figure 3:
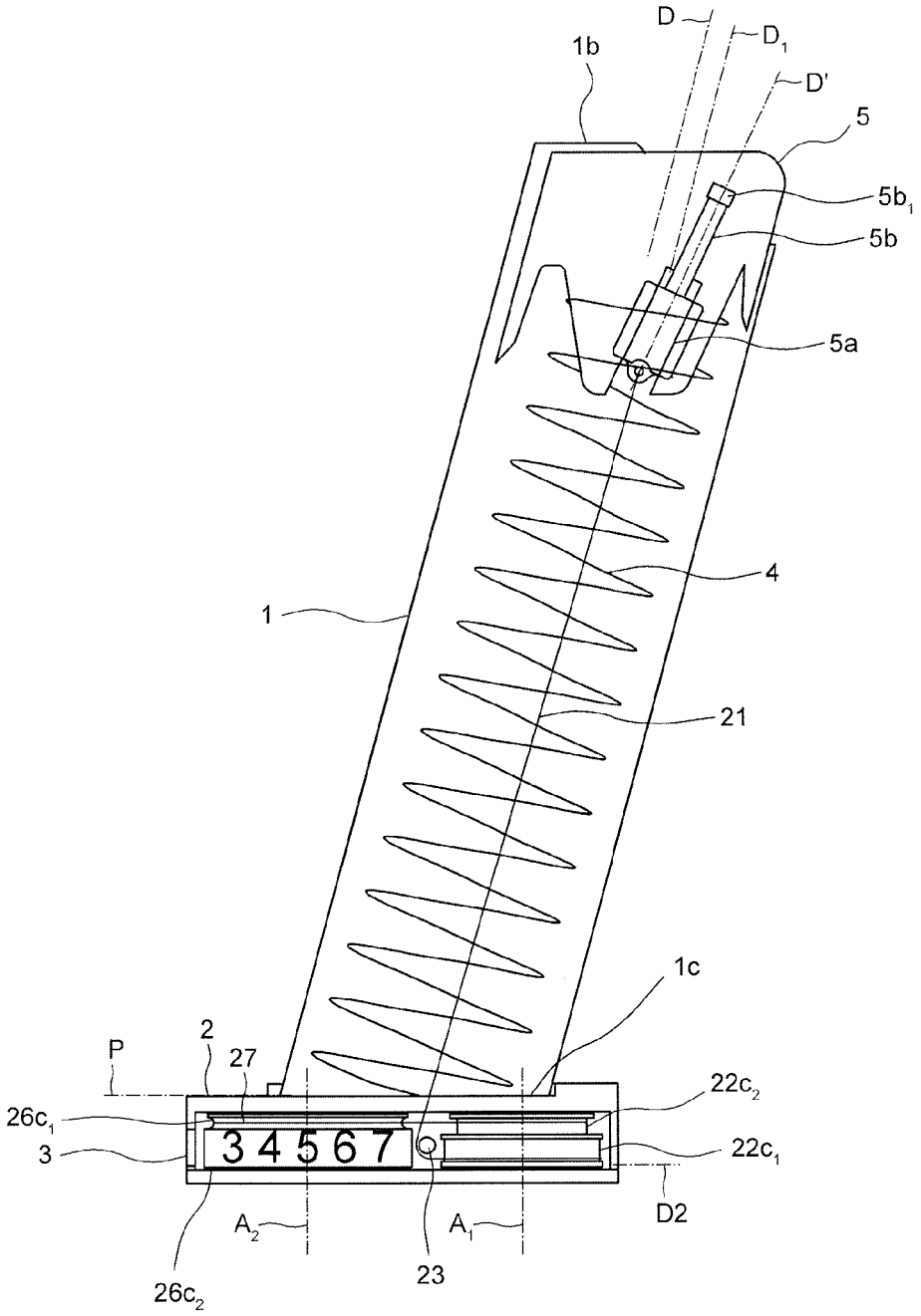
FIG. 3 is a schematic view of the magazine of FIG. 2 when empty of cartridges.

Reference is made to FIG. 2 which depicts the magazine 10 removed from the firearm 100, a longitudinal cutting of the housings 1 and 2 showing the constituent elements of this magazine. The main elements of this magazine notably comprise a helical spring 4 fully housed inside a central cavity 1*a* of the main housing 1, extending from its open upper end 1*b* as far as its open lower end 1*c*, said spring 4 pressing on the one hand against the upper face $2a_1$ of the secondary housing 2 and on the other hand against a follower 5 intended to push the cartridges 6 contained in the top part of the main housing 1 toward said upper end 1*b* under the action of said spring 4. The follower 5 is thus configured to slide inside said central cavity 1*a* in a longitudinal axial direction D, as depicted in FIG. 3, this sliding taking place under the impulse of the spring 4 on the one hand and the weight of the cartridges 6 on the other hand. Thus, when there is no cartridge contained in the magazine 10, as depicted in FIG. 3, the follower 5 comes into abutment against the upper end 1*b* of the housing 1. The assembly formed by the main housing 1 and the aforementioned main elements in fact defines a magazine that is conventional, aside from the fact that the plate, which is generally arranged at the lower end 1*c* of the housing 1 and against which the spring 4 presses, has been removed and replaced by the secondary housing 2, which will thus be fixed to the lower end 1*c* of the housing 1, preferably using removable means of attachment. In another possible configuration of the invention, it will also be conceivable to form the housings 1 and 2 as a single piece.

Figure 4B:
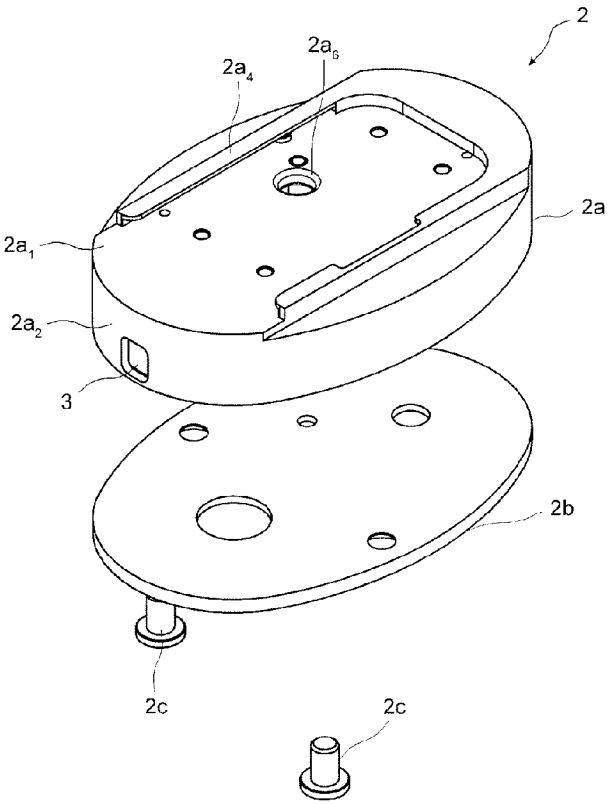
FIGS. 4*a* and 4*b* are exploded perspective views, from above and from below respectively, of a secondary housing with which the magazine of FIG. 2 is equipped.
Figure 4A:
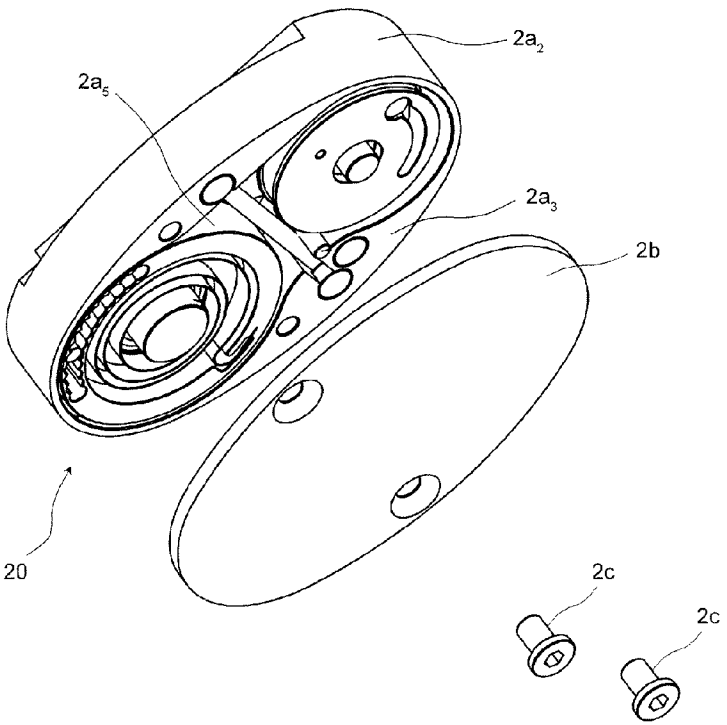

In the configuration depicted in FIGS. 4*a* and 4*b*, the secondary housing 2 is formed of an upper shell 2*a* and of a lower cover 2*b* fixed to the shell 2*a* using screws 20 for example. The shell 2*a* substantially defines a cylinder, of which the bases $2a_1$ and $2a_3$, of substantially oval or oblong shape, are connected via a lateral face $2a_2$. The oval or oblong shape of the bases $2a_1$ and 2*a* will advantageously correspond to the shape of the cross section of the butt 101 so that the magazine 10 can be incorporated seamlessly into the firearm 100. The opening 3 through which the user will be able to read the value corresponding to the number of cartridges remaining in the magazine is, moreover, advantageously positioned along the lateral face $2a_2$ and, preferably, in line with the plane that divides the shell 2*a* along its longest length. Positioned in this way, the opening 3 will be directly visible to the user when he is holding the firearm in its normal operating position. Furthermore, the shell 2*a* is advantageously equipped with a structural element $2a_4$ positioned to project at the upper face $2a_1$ thereof, said structural element $2a_4$ defining a guide rail against which a complementary shape (not depicted) provided at the lower end 1*c* of the main housing 1 slides. Thus it will be easy for the user to fix the secondary housing 2 onto the main housing 1 or, conversely, to separate the two housings 1 and 2 if the user wishes to carry out certain maintenance operations on the indicator device contained in the secondary housing 2. This indicator device 20 is notably housed almost completely inside a cavity $2a_5$ of the shell 2*a* opening onto the lower face $2a_3$.

Figure 5:
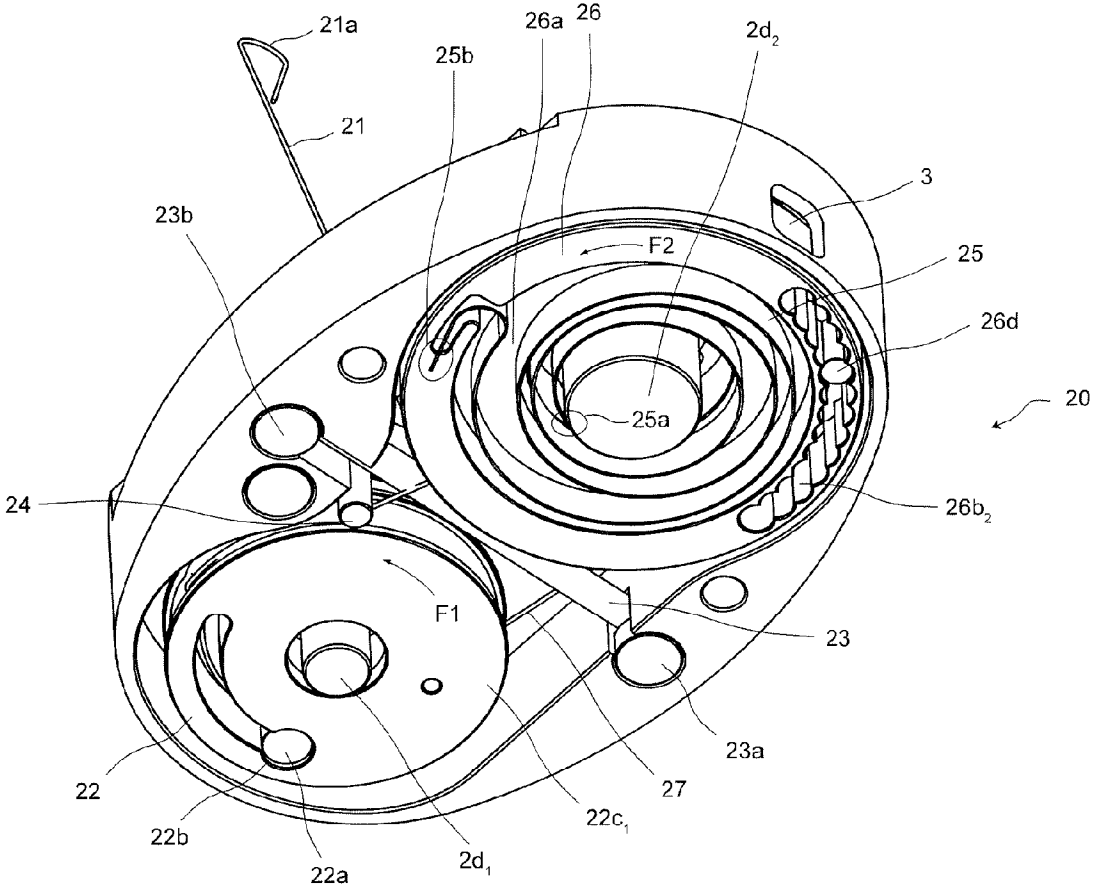
FIG. 5 is an enlarged view of FIG. 4*a*, in which the lower cover of the secondary housing has been removed so as to see the various constituent elements of an indicator device contained in said secondary housing and intended to indicate the number of cartridges contained in the magazine.

Reference is made to FIGS. 3 and 5 which depict a first possible configuration of the indicator device used in the magazine of the present invention.

In this configuration, the indicator device 20 is formed firstly of a flexible connecting means 21, of the wire or cable type, which is connected at its upper end 21*a* to a fixing support 5*a* housed inside the follower 5. The position of the fixing support 5*a* will advantageously be adjustable using a screw 5*b*, of which the head $5b_1$ will be accessible through a hole 5*c* formed in the upper face of the follower 5, as depicted in FIG. 2. In this way, the user will be able, by screwing or unscrewing the screw 5*b* to a greater or lesser extent in the fixing support 5*a*, to effect fine adjustment of the position of the fixing support 5*a* in a direction D' which is slightly inclined with respect to the axial direction D of the main housing 1. As described in greater detail later on, this adjustment will notably allow the display to be set so that the figures indicating the number of cartridges present in the magazine are correctly aligned with the opening 3. After having passed through the portion of the central cavity 1*a* of the main housing 1 which is positioned under the follower 5 and entered the secondary housing 2, notably via a through-hole $2a_6$ that causes the cavity $2a_5$ to communicate with the central cavity 1*a*, the flexible connecting means 21 is then fixed at its lower end to a rotary drum 22 housed inside the cavity $2a_5$, notably by means of a cylindrical pin 22*a* driven into a semi-cylindrical housing 22*b* of said rotary drum 22. Fixing may notably, in the case of a flexible connecting means of the wire type as depicted in FIG. 5, be achieved by knotting the wire 21 on itself at its lower end, said wire 21 having previously been introduced through a through-hole made through said cylindrical pin 22*a*. The rotary drum 22 is mounted inside the secondary housing 2 in such a way as to be able to turn about a first hub $2d_1$ arranged projecting with respect to the bottom of the cavity $2a_5$, said hub $2d_1$ defining an axis of rotation A1 substantially perpendicular to the plane P defined by the upper face $2a_1$ and therefore also by the lower end 1*c* of the main housing 1. This rotary drum 22 notably acts as a support onto which winds the wire 21 as the follower 5 gradually descends under the effect of the weight of the cartridges 6 introduced into the magazine 10. In particular, the rotary drum 22 will advantageously comprise a first cylindrical perimeter $22c_1$, in the form of a pulley, able to accept the wire 21 as it gradually winds up around the rotary drum 22. In order to allow the wire 21 to wind up correctly around this cylindrical perimeter $22c_1$, there are a number of means that have been provided. On the one hand, a first deflection means 23 able to cause said wire 21 to deflect from a first direction D1, in which it is substantially parallel to the direction D, to a second direction D2, in which it is substantially parallel to the plane P, has been provided inside the secondary housing 2. This first deflection means 23 is needed if one wants to avoid winding the wire 21 around a rotary drum 22 the cylindrical perimeter $22c_1$ of which is tangential to the direction D1, something which would not allow the height of the secondary housing 2 to be sufficiently limited. In the configuration depicted, this deflection means 23 consists of a cylindrical bar 23 fixed at its two ends 23*a*, 23*b* to the shell 2*a*, said bar 23 being positioned inside the cavity $2a_5$ so as to be tangential to the direction D1 of the wire 21. Thus, the wire 21 is wound up partially around said bar 21 before heading in the direction D2. In order to avoid any damage or even tearing of the wire 21, it will be preferable for the cylindrical bar 23 to have a completely smooth surface finish. In another configuration (not depicted) of the invention, this first deflection means may equally consist of a small-diameter pulley. Furthermore, a second deflection means 24 is advantageously positioned between the first deflection means 23 and the rotary drum 22 so as to reduce the angle of tangency between the wire 21 and the cylindrical perimeter $22c_1$. This angle of tangency in fact corresponds to the angle measured between the direction D2 of the wire 21 and the radius of the circle substantially described by the wire 21 during winding, at the point of contact of the wire 21 with the cylindrical, perimeter $22c_1$. This second deflection means 24 notably reduces the risk of the wire 21 becoming incorrectly positioned around the cylindrical perimeter $22c_1$ at the time of winding. It also prevents excessively high bending forces being applied to the first deflection means 23. In the configuration depicted, this second deflection means 24 consists of a cylindrical bar fixed at its upper end to the shell 2*a*, said bar being substantially parallel to the axis A1.

Furthermore, to facilitate the winding of the wire 21 or, in general, of the flexible connecting means, around the rotary drum 22, it is desirable for said wire 21, or said flexible connecting means, always to be kept taut, particularly when the follower 5 is moving, downward under the effect of the weight of the cartridges introduced into the magazine. To this end, it is advantageous to provide inside the secondary housing 2 a tensioning means which will be intended to tension said wire 21, or said flexible connecting means. In the configuration depicted, this tensioning means consists of a spiral-wound spring 25 which is connected at a first end 25*a* to a second hub $2d_2$ arranged to project from the bottom of the cavity $2a_5$ and at a second end 25*b* to a second rotary drum 26 mounted so as to rotate on said second hub $2d_2$ and driven in rotation at the same time as the first rotary drum 22, the axis of rotation A2 of this second rotary drum 26 being parallel to the axis of rotation A1 of the first rotary drum 22. The spiral-wound spring 25 will notably be configured to oppose the tensile load applied indirectly by the spring 4 to the wire 21. Advantageously, the second rotary drum 26 has a larger diameter than the first rotary drum 22 so that when the two drums 22 and 26 both rotate, the angular rotational speed of the second drum 26 is lower than the angular rotational speed of the first drum 22. As described in greater detail later on, this reduction effect of the second rotary drum 26 notably allows a greater number of figures to be displayed with a display means borne or, in any event driven, by said second rotary drum 26, thereby making it possible to use the indicator device 20 for larger-capacity magazines. In order to optimize as far as possible the space available inside the secondary housing 2, it will be advantageous to position the first and second rotary drums 22 and 26 in such a way that their respective mid-planes are substantially aligned with one another. Furthermore, the spiral-wound spring 25 is advantageously positioned inside an internal housing 26*a* of the second rotary drum 26, thereby avoiding the use of additional space inside the secondary housing 2 to house said spiral-wound spring 25. It is clear that such a configuration is merely one preferred exemplary embodiment. Other conceivable configurations may notably envision the use of another tensioning means, notably a compression spring, or positioning the spiral-wound spring, or the tensioning means in general, in such a way that it acts directly on the first rotary drum 22. Moreover, as depicted for example in FIGS. 7 to 9 and explained in greater detail hereinafter, the indicator device 20 may also not be equipped with a second rotary drum. In such cases, the display means mentioned above will be borne or, in any event driven by, the first rotary drum alone.

The turning of the two rotary drums 22 and 26 may be effected in various possible ways. It may notably be achieved by a torque transmission means. In the configuration depicted in FIGS. 3 and 5, this torque transmission means consists of a wire 27 connecting the first and second rotary drums 22 and 26. The wire 27 is fixed notably to said rotary drums 22 and 26 in such a way as to be able to wind up, as they both rotate, about corresponding cylindrical perimeters of said drums 22 and 26, namely a second cylindrical perimeter $\mathbf{22}c_2$ of the first rotary drum 22 and a first cylindrical perimeter $\mathbf{26}c_1$ of the second rotary drum 26, each of said cylindrical perimeters $\mathbf{22}c_2$ and $\mathbf{26}c_1$ being overall in the form of a pulley. However, it is clear that other torque transmission means could be used in place of said wire 27. In particular, the first and second rotary drums 22 and 26 could also be connected by a cable, a strip, a belt or a gearing.

Figure 6B:
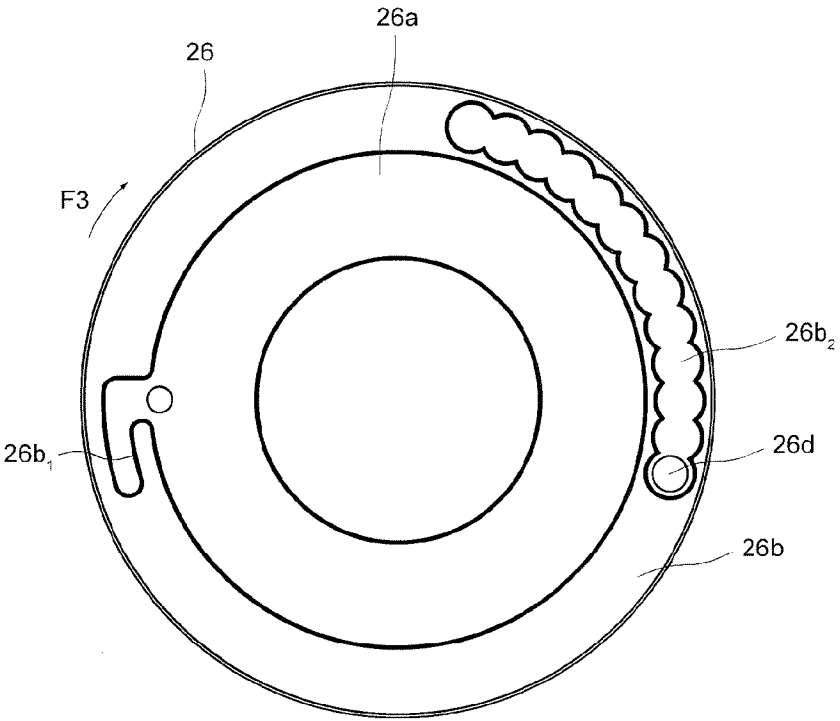
FIG. 6*b* is a view from beneath of the reduction drum of FIG. 6*a;*
Figure 6A:
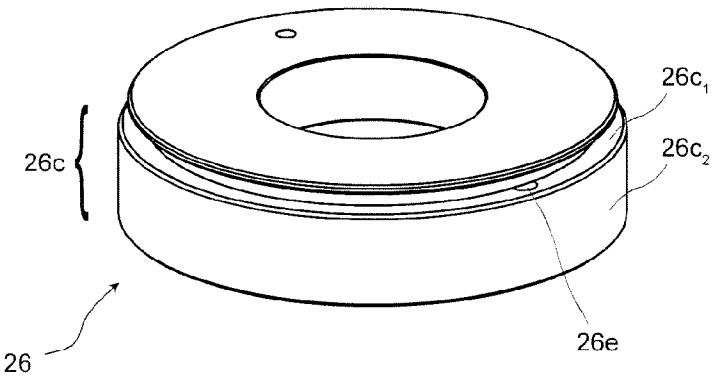
FIG. 6*a* is a perspective view of a reduction drum used within the indicator device depicted in FIG. 5.

FIGS. 6*a* and 6*b* depict in isolation the second rotary drum 26 of the indicator device 20 of FIG. 5. This second rotary drum 26 notably comprises a lateral face 26*c* which is defined by two adjacent cylindrical perimeters, namely an upper perimeter $\mathbf{26}c_1$, which has already been mentioned hereinabove and allows the winding of the wire 27 used as a torque transmission means, and a lower perimeter $\mathbf{26}c_2$, substantially delimiting a cylinder of revolution in which a central cavity 26*a*, which acts as a housing for the spiral-wound spring 25, is surrounded by an external annular flange 26*b* that performs a number of functions. Said external annular flange 26*b* notably comprises a first cavity $\mathbf{26}b_1$, in the shape of an L, into which the end 25*b* of the spiral-wound spring 25 is introduced before being fixed to the annular flange 26*b*. Thus, as the wire 21 is wound around the first rotary drum 22, said first drum 22 rotates about the axis A1 in the direction of rotation indicated by the arrow F1 in FIG. 5. This rotation causes a resultant rotation of the second rotary drum 26 about the axis A2 in the direction of rotation indicated by the arrow F2 in FIG. 5. This rotation causes the spring 25 to twist and this has a tendency to induce a reverse rotation of the second rotary drum 26 in the direction of rotation indicated by the arrow F3 in FIG. 6*b*. Moreover, the annular flange 26*b* comprises a second cavity $\mathbf{26}b_2$ defining a series of contiguous semi-cylindrical housings intended to accept a cylindrical pin 26*d*, in a similar way to the pin 22*a*, this cylindrical pin 26*d* has been configured to act as an anchor point for one of the ends of the wire 27. Thus by varying the position of the pin 26*d* along the cavity $\mathbf{26}b_2$ the user will be able to modify the relative angular positions of the two rotary drums 22 and 26, and this will allow coarse adjustment of the display of the value of the number of cartridges through the opening 3. To allow the wire 27 to pass from the cylindrical perimeter $\mathbf{26}c_1$ as far as the cavity $\mathbf{26}b_2$ it will be conceivable to provide a through-hole 26*e* through the annular flange 26*b*.

FIG. 3 also shows that the second cylindrical perimeter $\mathbf{26}c_2$ of the second rotary drum 26 comprises a series of consecutive figures uniformly spaced along its circumference. These figures correspond to the number of cartridges contained in the magazine 10. These figures are positioned in such a way as to be visible through the opening 3 formed through the shell 2*a* of the secondary housing 2, each figure being seen through said opening 3 in a very specific angular position of the second rotary drum 26 and, therefore also, of the first rotary drum 22. These very specific angular positions of the first rotary drum 22 are obtained for very specific corresponding positions of the follower 5 along the axis D, which positions are dependent solely on the number of cartridges contained in the magazine 10. However, it may happen that, following repeated use of the magazine 10, variations in the return force of the spring 4 or of the spring 25 occur. If that happens, the figures borne by the second rotary drum 26 may no longer align correctly with the opening 3 in the various specific positions of the follower 5 which were mentioned hereinabove. A similar situation could also arise if the secondary housing 2 equipped with the indicator device 20 were fitted to another type of magazine. In order to regain this correct alignment, the user would then need to act on the fine and coarse adjustment means mentioned hereinabove in order to adjust both the angular starting position of the first rotary drum 22 and the relative position between the first and second rotary drums 22 and 26. The angular starting position of the first rotary drum 22 in fact corresponds to the position of the drum 22 when the magazine 10 contains no cartridges, as depicted in FIG. 3. This position can therefore be adjusted by action on the screw 5*b*.

It is clear that the solution depicted in FIG. 3 does not limit the invention. In particular, it would be conceivable to position the figures corresponding to the number of cartridges contained in the magazine at some other location. Thus, these figures could also be positioned on a cylindrical perimeter of the first rotary drum if the magazine were configured to contain a small number of cartridges. In that case, it would be conceivable not to provide a second rotary drum. Moreover, if the torque transmission means were to be a belt, it would be conceivable to position the figures along the belt. Furthermore, the figures could also be replaced by a gauge of which the length visible through the opening 3 will be proportional to the number of cartridges contained in the magazine.

Figure 7:
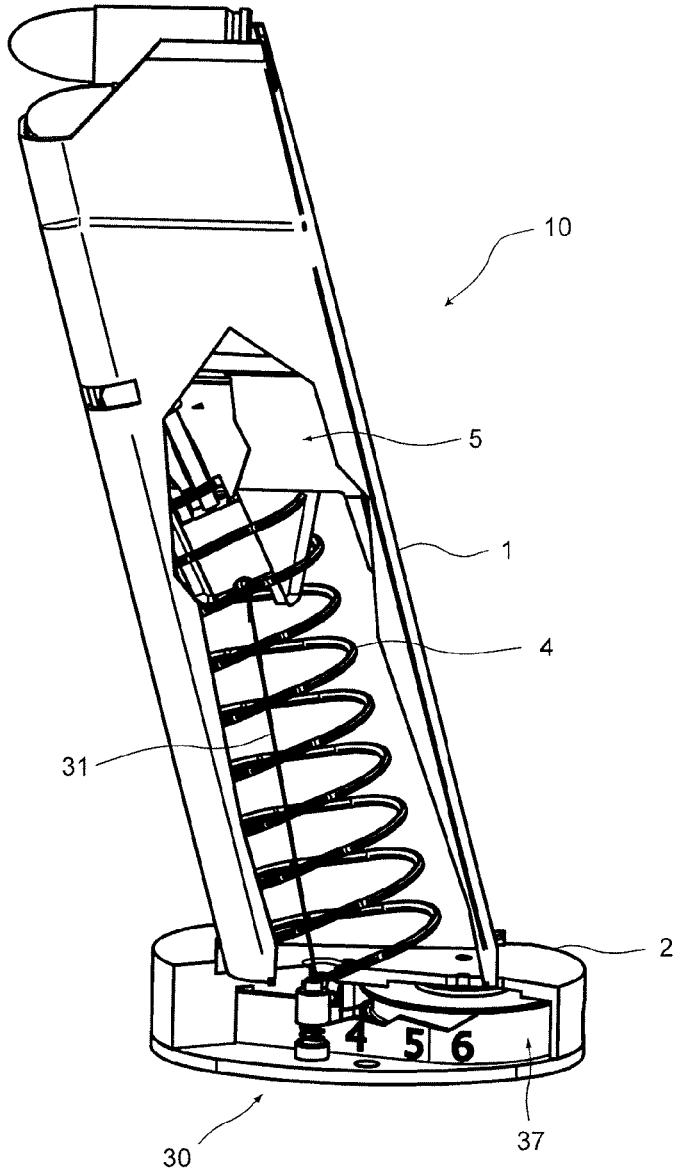
FIG. 7 is a perspective side view with cutaway of a self-contained magazine according to a second configuration of the invention.
Figure 8:
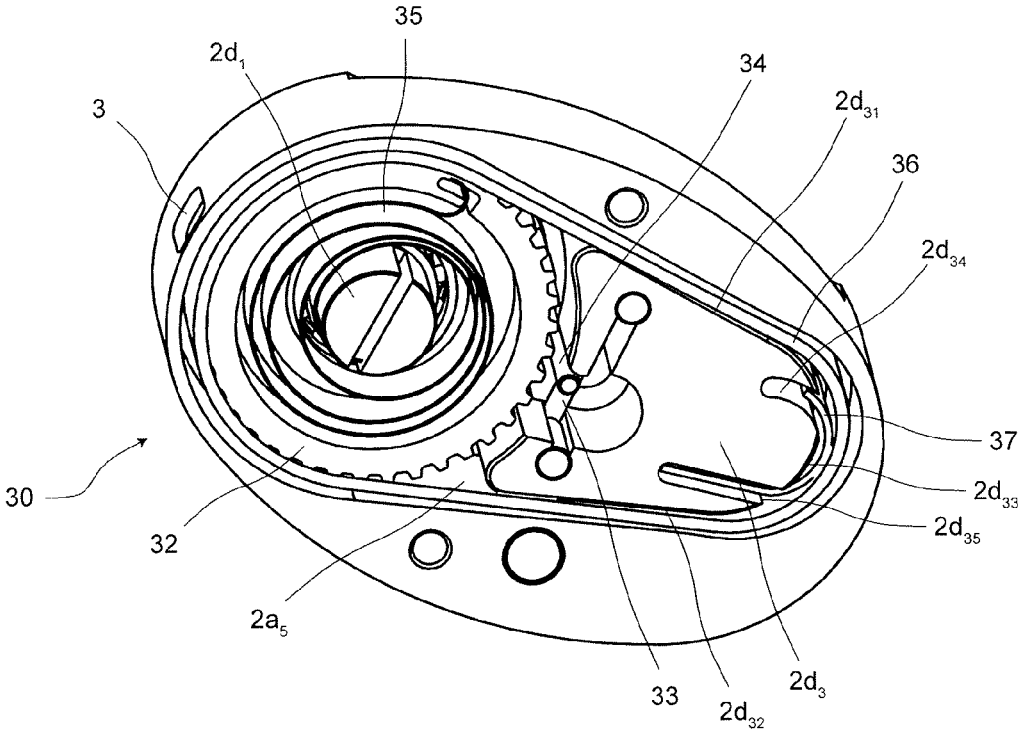
FIG. 8 is a perspective view from beneath of the secondary housing with which the magazine of FIG. 7 is equipped, in which figure the lower cover of the secondary housing has been removed so as to be able to see the various constituent elements of an indicator device contained in said secondary housing and intended to indicate the number of cartridges contained in the magazine.
Figure 9:
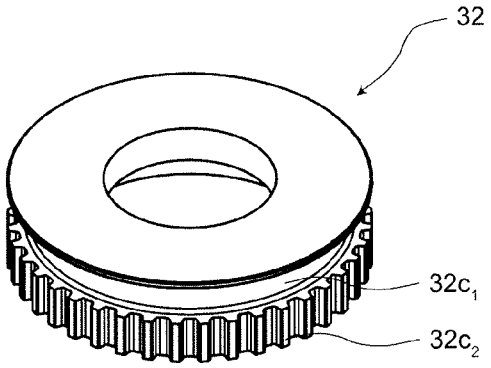
FIG. 9 is a perspective view of the winding drum used within the indicator device depicted in FIG. 8.

One of these alternative configurations is depicted with reference to FIGS. 7 to 9.

In this configuration, only the bottom part of the magazine 10, corresponding to the secondary housing 2 in which the indicator device is housed, has been modified in comparison with the configuration depicted in FIG. 2. The explanations given hereinabove regarding, the upper part of the magazine 10, corresponding to the main housing 1 and to the constituent elements contained in this main housing, therefore remain valid in this configuration. Although similar in many ways to the secondary housing depicted in FIGS. 4*a* and 4*b*, the secondary housing 2 of the present configuration differs therefrom in that it has just one hub $\mathbf{2}d_1$, the hub $\mathbf{2}d_2$ being replaced by a guide $\mathbf{2}d_3$ that forms a part raised up in relation to the bottom of the cavity $\mathbf{2}a_5$. The guide $\mathbf{2}d_3$ over its entire height has a substantially trapezoidal cross section, the convergent sides $\mathbf{2}d_{31}$ and $\mathbf{2}d_{32}$ of this guide $\mathbf{2}d_3$ being substantially straight so as to allow the translational guidance of a belt 36, as explained in detail hereinafter, and the short base of the trapezium, that forms one end $\mathbf{2}d_{33}$ of the guide $\mathbf{2}d_3$, having a rounded profile so as to allow rotational guidance of said belt 36. To make it easier to guide the belt 36 at the end $\mathbf{2}d_{33}$, a leafspring 37 will advantageously be positioned in such a way as to hold the belt 36 away from said end $\mathbf{2}d_{33}$. In the configuration depicted, the leafspring 37 has been notably curved so that its ends are housed inside slots $\mathbf{2}d_{34}$ and $\mathbf{2}d_{35}$ formed in the guide $\mathbf{2}d_3$ at the end $\mathbf{2}d_{33}$ thereof. The belt 36 forms one of the constituent parts of the indicator device 30 intended to display the number of cartridges present in the magazine 10 through the opening 3 of the secondary housing 2. This indicator device 30 notably comprises a flexible connecting means 31, of the wire type, intended to connect the follower 5 to a rotary drum 32, referred to as a winding drum, said winding drum 32 being mounted inside the secondary housing 2 so as to be able to turn about the hub $2d_1$ about an axis of rotation substantially perpendicular to the plane defined by the lower end of the main housing 1. Before being wound onto the winding drum 32, the wire 31 is first of all deflected from its path by first and second deflection means 33 and 34 positioned inside the secondary housing 2, said first and second deflection means 33 and 34 being substantially similar to the deflection means 23 and 24 of the previous configuration, whether from a structural or a functional viewpoint. Once deflected, the wire 31 is then wound around a first cylindrical perimeter $32c_1$ of said winding drum 32, said first cylindrical perimeter $32c_1$ substantially defining a pulley. In order for the wire 31 to be constantly taut as it is wound, a spiral-wound spring 35 housed inside a cavity of said winding drum 32 is configured to oppose the tensile force applied indirectly by the spring 4 to the wire 31, in the same way as does the spiral-wound spring 25 in the first configuration described. The winding drum 32 moreover comprises a second cylindrical perimeter $32c_2$ intended to drive the belt 36. For that purpose, said second cylindrical perimeter $32c_2$ is advantageously equipped, over its entire length, with a series of tooth-shape protrusions, uniformly spaced apart, thus giving said perimeter $32c_2$ the form of a toothed wheel. Thus, as the wire 31 is gradually wound around the winding drum 32 or, conversely, is unwound, the belt 36 is successively partially wound around the second cylindrical perimeter $32c_2$ of said drum 32, guided in rectilinear translation along one of the sides $2d_{31}$ and $2d_{32}$ of the guide $2d_3$, wound partially around the end $2d_{33}$ and once again guided in rectilinear translation along the other side $2d_{31}$ or $2d_{32}$ of said guide $2d_3$, before returning to its starting point. During its journey, the belt 36 is positioned in such a way that it files past the opening 3 of the secondary housing 2. As illustrated by FIG. 7, the belt 36 can thus act as a display means for displaying the number of cartridges contained in the magazine 10. For that purpose it will advantageously be equipped with a series of consecutive figures on its external face, said figures for example ranging from 1 to a limit value corresponding to the maximum capacity of the magazine, said figures being uniformly spaced along the belt 36, the spacing between two consecutive figures being proportional to the angular travel of the winding drum 32 brought about by the raising or lowering of the follower 5 following the ejection or introduction of a cartridge into or from the magazine 10. As a subsidiary issue, the figures could be replaced by a gauge of which the length visible through the opening 3 with approximately indicate the number of cartridges remaining. The figures or the gauge may also bear color codes so as to clearly indicate to the user that the magazine is empty, or practically empty or, on the other hand, full, or practically full. Moreover it may also be beneficial for the magazine 10 to be equipped with an autonomous illumination device, so that the figures or the gauge can be read in the dark. This illumination device may run on any type of light source, notably by means of a radioactive source, such as tritium, or a bulb fitted with batteries.

The invention claimed is:

1. A self-contained magazine intended for a firearm, comprising:

a main housing intended to receive a plurality of cartridges, said main housing comprising an open upper end through which the cartridges are loaded and unloaded, a follower arranged in said main housing, said follower being able to slide in a longitudinal axial direction of said main housing, a spring urging the follower toward said upper end so as to push the cartridges toward said upper end, a secondary housing fixed to a substantially planar lower end of said main housing, an indicator device arranged at least partially inside said secondary housing and intended to indicate a number of cartridges contained in the main housing, wherein the indicator device comprises:

a rotary drum comprising a winding drum arranged inside the secondary housing and of which an axis of rotation of the winding drum is substantially perpendicular to a plane defined by the lower end of the main housing, a flexible connector configured to connect the follower to said winding drum, said winding drum being configured to allow said flexible connector to be wound and, respectively, unwound, around at least part of a peripheral perimeter thereof as said follower nears or, respectively, moves away from, said lower end, a tensioner configured to tension the flexible connector, as the flexible connector is being wound around the winding drum, at least one deflector configured to alter a direction defined by the flexible connector in such a way that said direction is substantially parallel to an axial direction of the main housing in a portion extending between the follower and said deflector and that said direction is substantially parallel to the plane defined by the lower end of the main housing in a portion extending between said deflector and the winding drum, a display configured to display the number of cartridges contained in the main housing according to an angular position of the winding drum.

2. The magazine as claimed in claim 1, wherein said flexible connector is filiform comprising a wire or a cable.

3. The magazine as claimed in claim 1, wherein said tensioner comprises a spring connected at a first end to the secondary housing and at a second end to the winding drum.

4. The magazine as claimed in claim 3, wherein the display comprises a marking affixed to the winding drum and visible through an opening made in the secondary housing.

5. The magazine as claimed in claim 3, wherein the display comprises a marking affixed to a belt driven by the winding drum and visible through an opening made in the secondary housing.

6. The magazine as claimed in claim 1, wherein said tensioner comprises a spiral-wound spring arranged fully inside an internal housing of the winding drum.

7. The magazine as claimed in claim 1, wherein said tensioner comprises a spring connected at a first end to the secondary housing and at a second end to a reduction drum, rotationally driven at the same time as said winding drum, an axis of rotation of said reduction drum being substantially parallel to the axis of rotation of said winding drum.

8. The magazine as claimed in claim 7, wherein said spring is a spiral-wound spring which is located fully inside an internal housing of the reduction drum.

9. The magazine as claimed in claim 7, wherein said winding drum and said reduction drum are both rotationally driven by a torque transmission.

10. The magazine as claimed in claim 9, wherein said torque transmission is chosen from a belt, a cable, a wire or a gearing.

11. The magazine as claimed in claim 10, wherein the display comprises a marking affixed to a belt driving both said winding drum and said reduction drum and visible through an opening made in the secondary housing.

12. The magazine as claimed in claim 11, wherein said marking consists of a series of consecutive figures, uniformly spaced on an external perimeter of said winding drum, of said reduction drum or of said belt, the figures corresponding to the number of cartridges contained in the main housing.

13. The magazine as claimed in claim 11, wherein said marking consists of a gauge present on an external perimeter of said winding drum, of said reduction drum or of said belt, a length of said gauge visible through said opening being proportional to the number of cartridges contained in the main housing.

14. The magazine as claimed in claim 13, wherein a height of the secondary housing, measured in a direction substantially parallel to the axis of rotation of the winding drum, is less than 2 cm.

15. The magazine as claimed in claim 7, wherein a mid-plane of the winding drum is aligned with a mid-plane of the reduction drum so as to optimize a space available inside the secondary housing.

16. The magazine as claimed in claim 7, wherein the display comprises a marking affixed to the reduction drum and visible through an opening made in the secondary housing.

17. A combination of a firearm intended to fire cartridges, said firearm comprising a magazine housing, and of a self-contained magazine as claimed in claim 1, designed to be accommodated in said magazine housing for the purpose of feeding the firearm with cartridges.

18. The combination as claimed in claim 17, wherein an opening is made in the secondary housing of the magazine so as to allow the number of cartridges contained in said magazine to be displayed, said opening being positioned in such a way that said opening faces toward a user holding the firearm.

* * * * *